United States Patent [19]
Leikert et al.
[11] 4,426,938
[45] Jan. 24, 1984

[54] METHOD OF PREPARING IGNITION FUEL PURSUANT TO FLOW DYNAMICS FROM A PRIMARY FUEL FLOW FOR A PULVERIZED FUEL PILOT LIGHT

[75] Inventors: Klaus Leikert, Gummersbach; Klaus-Dieter Rennert, Marienheide, both of Fed. Rep. of Germany

[73] Assignee: L. & C. Steinmüller GmbH, Gummersbach, Fed. Rep. of Germany

[21] Appl. No.: 348,251

[22] Filed: Feb. 12, 1982

[30] Foreign Application Priority Data

Feb. 16, 1981 [DE] Fed. Rep. of Germany ..... 3105628

[51] Int. Cl.³ ..... F23D 1/00

[52] U.S. Cl. ..... 110/347; 110/232; 110/261; 110/264; 431/278

[58] Field of Search ..... 110/106, 232, 260, 261, 110/263, 265; 431/278, 42

[56] References Cited

U.S. PATENT DOCUMENTS

| | | | |
|---|---|---|---|
| 748,310 | 12/1903 | Thielbeule et al. | 431/278 |
| 2,293,737 | 8/1942 | Hardgrove | 110/232 |
| 2,385,508 | 9/1945 | Hammond | 110/332 |
| 3,007,517 | 11/1961 | O'Cathey | 431/278 |
| 3,393,650 | 7/1968 | Daman et al. | 110/261 |
| 4,333,405 | 6/1982 | Michelfelder et al. | 110/264 |

*Primary Examiner*—Henry C. Yuen
*Attorney, Agent, or Firm*—Becker & Becker, Inc.

[57] ABSTRACT

A method of igniting a pulverized-coal annular burner flame having an internal back flow region, with the ignition energy being introduced centrally into the interior of the back flow region of the pulverized-coal annular burner flame. The ignition energy for the annular burner flame is furnished by an ignited pulverized-fuel igniting flame or pilot light, which is operated with pulverized fuel having a different coarseness and/or consistency than does the primary fuel. Pulverous ignition fuel is withdrawn from the conduit of the primary fuel stream after an existing pulverizing plant at a location which is advantageous with regard to flow dynamics. The ignition fuel is withdrawn by means of a withdrawal device which is capable of being shut off, with the withdrawal opening thereof being directed in the direction of the primary fuel flow.

2 Claims, 1 Drawing Figure

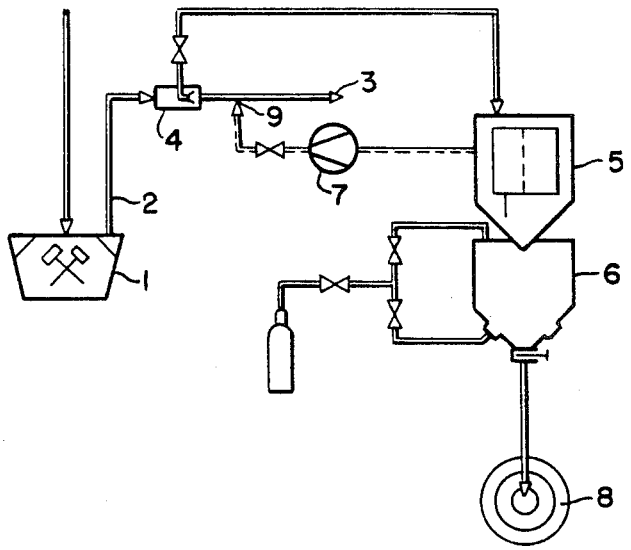
1
2
3
4
5
6
7
8
9

METHOD OF PREPARING IGNITION FUEL PURSUANT TO FLOW DYNAMICS FROM A PRIMARY FUEL FLOW FOR A PULVERIZED FUEL PILOT LIGHT

The present invention relates to a method of igniting a pulverized-coal annular burner flame having an internal back flow region, with the ignition energy being introduced centrally into the interior of the back flow region of the pulverized-coal annular burner flame; the ignition energy for the annular burner flame is furnished by an ignited pulverized-fuel igniting flame or pilot light, which is operated with pulverized fuel having a different coarseness and/or consistency than does the primary fuel. The type of burner with which the method of the instant invention is used is exemplified by the burner disclosed in U.S. Pat. No. 4,333,405 issued June 8, 1982, to Sigfrid Michelfelder and Klaus Leikert and assigned to L and C Steinmuller GmbH, which patent is incorporated herein by reference. The assignee and inventorship of U.S. Pat. No. 4,333,405 and that of the instant application are identical.

Coal or another solid fuel is employed for the operation of a pulverized-fuel igniting flame or pilot light, especially with pulverized-coal firing. In order to avoid a special or separate production of the ignition fuel, it is economically more advantageous to withdraw the ignition fuel from the primary fuel quantity.

It is therefore an object of the present invention to provide a method with which the ignition fuel is taken from the primary fuel quantity and is simultaneously appropriately prepared for the ignition procedure.

This object, and other objects and advantages of the present invention, will appear more clearly from the following specification in connection with the accompanying drawing, which schematically illustrates one embodiment for carrying out the method of the present invention.

The method of the present invention is characterized primarily by withdrawing the pulverous ignition fuel from the conduit of the pneumatically conveyed primary fuel after an existing pulverizing or grinding plant and at a location which is advantageous with regard to flow dynamics; the ignition fuel withdrawn by means of a withdrawal device which is capable of being shut off, with the withdrawal opening thereof being directed in the direction of the primary fuel flow.

The withdrawal device can be adjusted with respect to the depth of the cross sectional plane of the conduit of the primary fuel flow in order to withdraw pulverized fuel dust of desired coarseness and/or consistency from the conduit of the primary fuel flow. Additionally, the grain-size distribution of the pulverous ignition fuel to be withdrawn can be precisely affected or varied by changing the withdrawal speed.

The quantity of the ignition fuel/carrier air mixture withdrawn by means of the withdrawal device can be regulated in conformity to the output of the pulverizing plant.

The withdrawn ignition fuel/carrier air mixture is separated in a separator, with the ignition fuel being temporarily stored in a deactivatable bunker before it is supplied to the pulverized-fuel igniting flame or pilot light. The thus purified carrier air, on the other hand, is returned to the primary fuel flow after the withdrawal location.

Referring now to the drawing in detail, a primary pulverized coal/carrier air mixture is conveyed from a pulverizing or grinding plant 1 via a conduit system 2 to the main burner 3. At a location which is advantageous with regard to flow dynamics, an ignition fuel/carrier air quantity is drawn off at an adjustable speed by means of the induced-draft blower 7 via the withdrawal device 4. The withdrawal opening of the device 4 extends in the direction of the primary fuel flow, and the device 4 is adjustable with respect to the depth of the cross sectional plane of the primary fuel conduit in conformity with the output of the pulverizing plant 1. The ignition fuel/carrier air quantity is conveyed to the separator 5. Here the ignition fuel is separated from the carrier air and is temporarily stored in a deactivatable bunker 6, from which the pulverized-fuel igniting flame or pilot light 8 is supplied. The thus purified carrier air is returned from the separator 5 via the induced-draft blower 7 into the existing main fuel conduit at the location 9.

The present invention is, of course, in no way restricted to the specific disclosure of the specification and drawing, but also encompasses any modifications within the scope of the appended claims.

What we claim is:

1. A method for supplying solid, pulverized fuel to a pulverized-fuel pilot light of an annular flame, coal dust burner, said method comprising the steps of:

A. supplying the coal dust burner with a fuel stream comprising a mixture of pulverized fuel and carrier air from a pulverizing plant via a main fuel supply conduit, wherein the stream has a cross-section with areas of pulverized fuel having different grain sizes;

B. selectively withdrawing a portion of the pulverized fuel and carrier air at a withdrawal site in the main fuel supply conduit; the withdrawal being from a selected location in the cross-section of the stream of pulverized coal and carrier air and being made through a withdrawal opening which faces in the upstream direction with respect to the direction of flow of the stream so as to withdraw pulverized fuel of a grain size different from that comprising the cross-section of the entire stream;

C. separating the withdrawn pulverized fuel from the carrier air and returning the carrier air to the main conduit at a location downstream from the site of the withdrawal;

D. feeding the withdrawn pulverized fuel to a storage bunker for a subsequent burning by the pilot light;

E. feeding the withdrawn pulverized fuel from the storage bunker to the pilot light when the coal dust burner is extinguished wherein a flame is available for reigniting the coal dust burner when ignition is necessary, and F. withdrawing additional portions of pulverized fuel in accordance with step "B" to keep a sufficient supply of pulverized fuel of selected grain size in the storage bunker for use by the pilot light when the coal dust burner is extinguished.

2. The method of claim 1 further including the step of varying the grain size distribution of the withdrawn pulverized fuel by changing the speed at which the pulverized fuel and carrier air are withdrawn.

* * * * *